US005967831A

United States Patent [19]

Yamada et al.

[11] Patent Number: 5,967,831

[45] Date of Patent: Oct. 19, 1999

[54] ELECTRICAL CONNECTOR ASSEMBLY

[75] Inventors: Shoji Yamada, Tokyo; Yoshihisa Yamamoto; Kazushige Asakawa, both of Yokohama; Hiroyuki Obata, Kawasaki, all of Japan

[73] Assignee: The Whitaker Corporation, Wilmington, Del.

[21] Appl. No.: 08/849,776

[22] PCT Filed: Jan. 23, 1996

[86] PCT No.: PCT/US96/01134

§ 371 Date: Jun. 12, 1997

§ 102(e) Date: Jun. 12, 1997

[87] PCT Pub. No.: WO96/23331

PCT Pub. Date: Aug. 1, 1996

[30] Foreign Application Priority Data

| | | | |
|---|---|---|---|
| Jan. 23, 1995 | [JP] | Japan | 7-27319 |
| Jan. 31, 1995 | [JP] | Japan | 7-13951 |
| May 12, 1995 | [JP] | Japan | 7-138767 |
| Aug. 4, 1995 | [JP] | Japan | 7-296049 |

[51] Int. Cl.[6] ..... H01R 9/07

[52] U.S. Cl. ..... 439/496; 439/79; 439/108

[58] Field of Search ..... 439/495, 496, 439/497, 108, 79, 80, 67, 77

[56] References Cited

U.S. PATENT DOCUMENTS

| | | | |
|---|---|---|---|
| 3,158,421 | 11/1964 | Hasenauer, Jr. | 439/67 |
| 3,337,834 | 8/1967 | Godwin et al. | 439/497 |
| 3,923,364 | 12/1975 | Shapiro et al. | 439/496 |
| 4,749,371 | 6/1988 | Hirai et al. | 439/497 |
| 5,414,220 | 5/1995 | Hanato et al. | 439/77 |

FOREIGN PATENT DOCUMENTS

| | | |
|---|---|---|
| 0214830A2 | 9/1986 | European Pat. Off. . |
| 72.25292 | 7/1972 | France . |

*Primary Examiner*—Neil Abrams
*Attorney, Agent, or Firm*—Salvatore Anastasi

[57] ABSTRACT

Connector housings (11, 12) to be mounted on a printed circuit board (100) have a plurality of rows of contacts (13, 14) extending from wall surfaces of the housing (11, 12). These contacts (13, 14) are soldered to conductive pads (23) of a flexible circuit (20). The flexible circuit (20), bent in a generally U-shaped, about an insertion portion (31) of a metallic guide portion (30) which is to be inserted between rows of contacts (50) of a mating connector (40) for interconnection therebetween. The guide member (30) preferably engages a ground conductor (176) on the reverse surface of the flexible substrate and includes extending portions (142) to groundingly engage conductive member (43, 124) positioned at both ends of the housing. In an alternate embodiment strengthening plates may be adhered to the flexible circuit between the opposed arrays of conductive pads and ground contact pads.

13 Claims, 15 Drawing Sheets

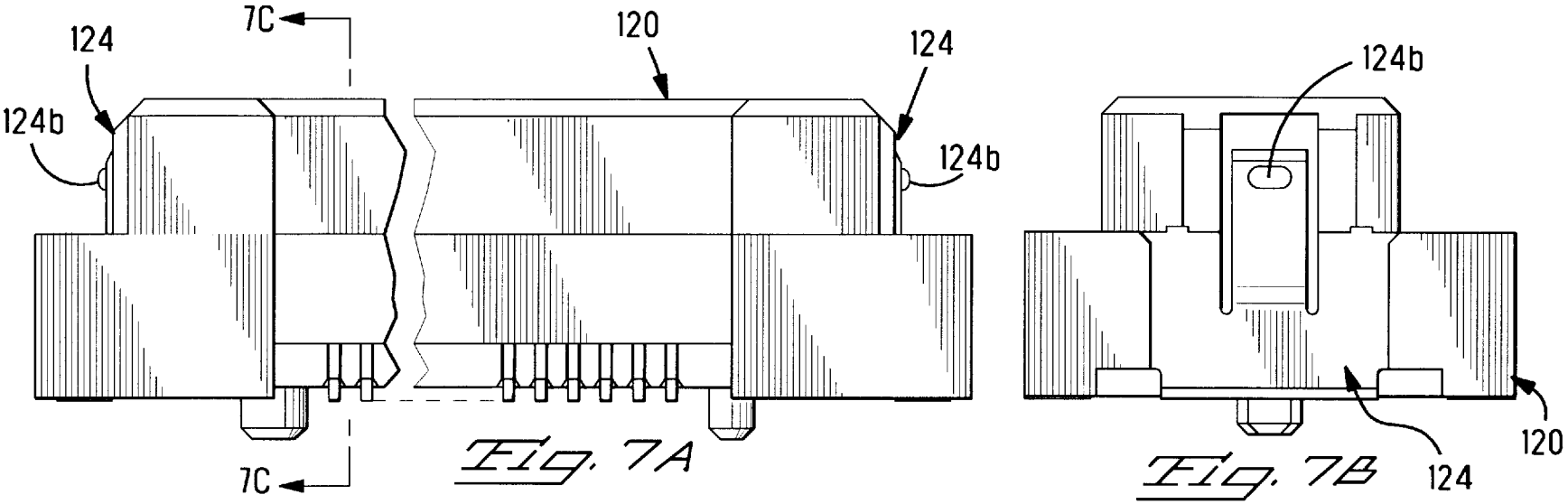
Fig. 7B
Fig. 7A
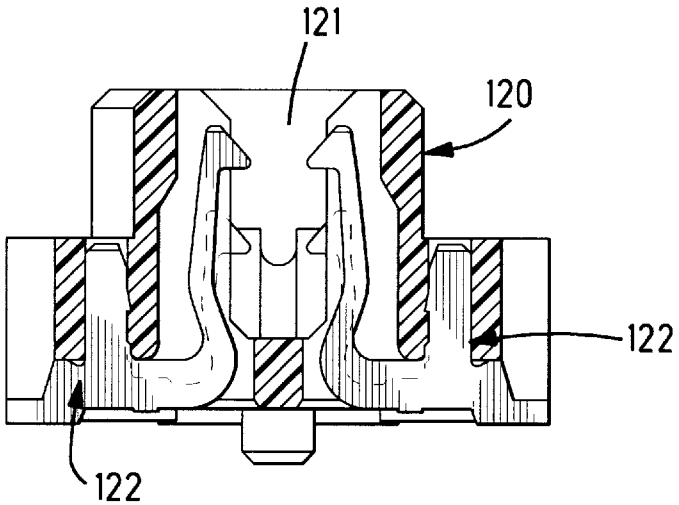
Fig. 7C

ELECTRICAL CONNECTOR ASSEMBLY

FIELD OF THE INVENTION

The present invention relates to an electrical connector, more specifically to a high density electrical connector such as a PC card connector that uses a flexible circuit for interconnecting the contact of the PC connector to another connector mounted on a circuit hoard.

BACKGROUND OF THE INVENTION

Advances in electronic devices including microprocessors have created a large market for compact electronic apparatus using memory or PC cards, hard disk drives (HDDs), etc. A docking connector or a memory card connector is used in such electronic apparati. The docking connector is used to interconnect another similar electronic apparatus for creating a network and also to connect peripheral equipment such as a submemory apparatus. A memory card connector receives one or more memory card or an HDD for electrical connection thereto.

Recently, needs have arisen for card type devices known a PC cards for expansion or additional performance of compact electronic equipment such as notebook personal computers. Such PC cards are normally received in a PC card connector installed in a compact electronic equipment to provide added memory capacity or interfacing with external devices such as peripheral equipment. Typically, PC card connectors have dual stacked connector mating portions to permit reception of three types of PC cards, i.e., Type I, Type II and Type III.

These docking connectors and PC or memory card connectors include a plurality of contacts often more than one hundred disposed in a matrix having a plurality of rows. Such contacts are bent at right angles or in an L-shape with respect to the connector and are soldered to respective conductive paths or traces on a main PC board. One example of such memory card connector is disclosed in U.S. Pat. No. 5,324,204. In this particular example, four rows of contacts are bent in a staggered relationship to be connected to the main PC board in eight rows.

Typical examples of such connectors also are disclosed in Japanese Patent Publication, No. 6-332573 and Japanese UM Publication No. 6-56992. The former connector has contacts aligned in a connector housing and bent at substantially right angles at the rear position to be connected to a rain circuit board. In the latter connector, contacts of dual stacked connectors extend at their rear positions toward each other, i.e., toward the center position to be connected to an auxiliary circuit board at the center position, thereby interconnecting the auxiliary and main circuit boards by the board-to-board connector.

Unfortunately, as electronic equipment becomes more compact, a higher density of contacts is required. The individual contacts, therefore, have smaller dimensions and pitch, which makes it difficult to form reliable connections with a main circuit board using a connector having relatively long solder tines of the contacts of the former connector. Although the latter connector is effective to realize relatively fine pitch connections, the connector requires a larger number of components, thus making it more difficult to manufacture and more expensive.

Moreover, a standard to form signal and ground (SG) of PC card connectors has been added recently. One object is to isolate signals to be transmitted through one connector from those transmitted through another connector, thereby preventing noise due to cross talk. Unfortunately, however, such noise protection is not always sufficient in conventional connectors.

Additionally, in the above conventional connectors, the connection or mounting location of the connector or its contacts on a main circuit board is required to be predetermined, thereby restricting the design of the main circuit board and precise manufacture of conductive through hole patterns, etc. with small tolerances. It is, therefore, desirable to provide flexibility in connection or mounting.

Using a flexible circuit (FC) for interconnecting circuits on a substrate such as a small-size printed circuit board (PCB) and high-density-mounted electronic equipment is known in the art. Such an electrical connector for an FC generally comprises a plurality of contacts to be engaged with conductive pads formed on the FC, a housing for disposing and holding the contacts, and a movable plastic cover or other member for pushing the FC into the housing and the conductive pads formed thereon into positive engagement with the contacts in the housing. Examples of conventional electrical connectors for FC are disclosed in a Japanese Patent Publication No. 61-131382, a Japanese UM Publication No. 2-120780, and a Japanese Patent Publication No. 5-251140.

U.S. Pat. No. 3,923,364 discloses an electrical connector assembly including a housing having a plurality of contacts disposed along an elongate opening; a shielded flexible substrate having a width corresponding to the opening of the housing and conductive signal traces and pads and ground conductive pads on one surface thereof corresponding to the contacts in the housing; and a guide member having a plate portion to be disposed in a flexible substrate bent in a generally U-shape with the one surface outside to be inserted into the opening of the housing whereby, upon inserting the guide member and substrate into the housing opening, the signal and ground pads on the one surface of the substrate are electrically engaged to corresponding contacts in the housing.

As electronic equipment becomes smaller with a higher density of contacts, e.g., the pitch of the contacts is less than 0.5 mm, the dimensions of the contacts to be used therein will also become smaller and, therefore, be more easy to deform. It is very difficult to accurately position the contacts, especially their solder-terminating portions, in the desired location and to maintain them so as not to deform the contacts upon handing and mounting the connector on to the substrate.

Also, for the electrical connector utilizing the FC, it is difficult to precisely and firmly urge the movable plastic cover to engage over the full width of the FC with the plurality of contacts without having some deformation over the full width of the FC. Accordingly, reliability of connection between the conductive pads and the contacts has been decreased.

Therefore, an object of this invention is to provide a small and high density electrical connector assembly, that utilizes the FC and enables simple structure and easy handling.

It is another object of this invention to provide an electrical connector assembly having a ground function and permitting easy handling in which the plurality of the conductive pads on the FC and the contacts in the housing are interconnected with high reliability.

It is yet another object of this invention to provide an electrical connector assembly for card bus, which enables one or more memory card connector etc. to connect easily and reliably to the PC board.

In order to solve the problems of the prior art electrical connector assembly and to achieve the above mentioned objects, the electrical connector assembly of the present invention comprises a housing having plural rows of contacts, a substrate, such as a flexible printed circuit board (FC) to be connected to the contacts of the housing at both ends of the flexible printed circuit board, said printed circuit board having a plurality of conductive traces and pads, and a guide member to be inserted in the FC, the guide member being bent in a generally U-shape to force the FC between rows of contacts of a corresponding connector to interconnect the conductive traces and contacts.

In accordance with one aspect of the present invention, the electrical connector assembly includes a housing having a plurality of contacts disposed along an elongate opening; a flexible substrate having a width corresponding to the opening of the housing and conductive traces on one surface thereof corresponding to the contacts in the housing; and a guide member having a plate portion to be disposed in a flexible substrate bent in a generally U-shape with the one surface outside to be inserted into the opening of the housing. The connector assembly is characterized in that: the housing includes a ground conductive member at at least one end thereof; the flexible substrate is formed with a ground conductor on the other surface thereof; and the guide member is a conductive member adapted to further provide a connection to ground for the assembly whereby the contacts and the conductive traces are electrically connected by the force exerted by the guide member on the flexible substrate and the ground conductor of the substrate is connected to the ground conductive member of the housing by the guide member.

In one embodiment of the invention using a flexible substrate having conductive traces on one surface, the assembly further includes strengthening plates disposed on the other surface of the substrate at the locations corresponding to the conductive pads.

One aspect of the present invention is an FC having two arrays of corresponding conductive pads and conductive traces on one surface with the plurality of conductive pads of the arrays arranged in rows in an opposed relationship. A plurality of openings are disposed between the arrays leaving narrow bridge portions between adjacent openings. Strengthening plates are attached to the reversed surface at the positions corresponding to the conductive pads with portions of the strengthening plates extending into the openings by a predetermined length.

Also, another aspect of the present invention is a flexible circuit (FC) comprising conductive traces on one surface of a central film, a ground layer on the reverse surface, and cover layers disposed to cover the conductive traces and the ground layer. A plurality of openings are formed in the cover layers substantially in rows at selected locations that avoid the conductive traces.

The FC according to the present invention has openings in the direction of the width at substantially center position between the rows of the conductive pads. The openings define the relatively narrow bridge portions of the FC. The FC has a pair of strengthening plates adhered to both sides of the openings and at least one surface of the FC. The pair of strengthening plates have edges extending into the openings by a desired length from both sides thereof.

Additionally, the FC according to the present invention has a plurality of recesses arranged substantially in rows near the bent portion. The recesses are preferably formed by removing a part of one layer of a multiple-layer FC, thereby allowing the FC to bend smoothly at a desired position.

The FC is bent or folded along the bridge portions before being inserted into a connector along with a guide member, and upon full insertion of the board and guide member, the conductive pads of the FC are electrically connected with contacts in the connector. The edge portions of the strengthening plates then abut the bottom in the housing for proper positioning of the FC in the connector, thereby assuring reliable electrical connection between the conductive pads and the contacts. Also, it is bent at a desired angle, preferably a right angle along the recesses, thereby permitting connection to a connector such as the PC card connector or other device at the edge portion. Since the electrical connector assembly comprises a FC with no individual contacts bent at right angle with respect to a wall or L-shape as seen in the prior art electrical connector assembly, the connector of the present invention eliminates deformation of the guide between the contacts and disengagement and short circuit caused therebetween. Accordingly, stable electrical connections and easy handling are achieved. Also, the structure having the FC connected to the contacts on the housing at the both ends thereof enables high density.

According to another aspect of the present invention, the electrical connector comprises a housing having two rows of contacts alone an elongate opening, a flexible printed circuit board having a plurality of conductive traces on a surface corresponding to these contacts, and a guide member having a generally planer portion to be inserted into a U-shaped bent portion of the flexible printed circuit board, wherein the conductive traces on the flexible printed circuit board are forced between the rows of the contacts by means of the guide member for establishing electrical interconnection between the conductive traces and the contacts in the housing, thus electrically connecting the contacts with corresponding contacts of at least one electrical connector terminated to the ends of the FC.

According to the electrical connector assembly, it is possible to connect the high frequency signals to the contacts through the conductive traces on the surface of the FC. The FC is bent in a U-shape to envelope the guide such that the guide electrically engages the ground conductor of the FC board and upon inserting the FC into the housing, the guide electrically engages the ground conductive members of the housing. Since all the conductive traces formed on the one surface of the FC can be signal traces, a high density and high frequency electrical connector is obtained.

BRIEF DESCRIPTION OF THE DRAWINGS

The present invention will now be described by way of example with reference to the accompanying drawings.

FIG. 7A shows a front view of the housing of the electrical connector assembly of FIG. 5.

FIG. 7B shows a side view of the housing of the electrical connector assembly of FIG. 5.

FIG. 7C shows a cross-sectional view taken along the line 7C—7C of FIG. 7A.

DETAILED DESCRIPTION OF AN EMBODIMENT OF THE INVENTION

Figure 1:
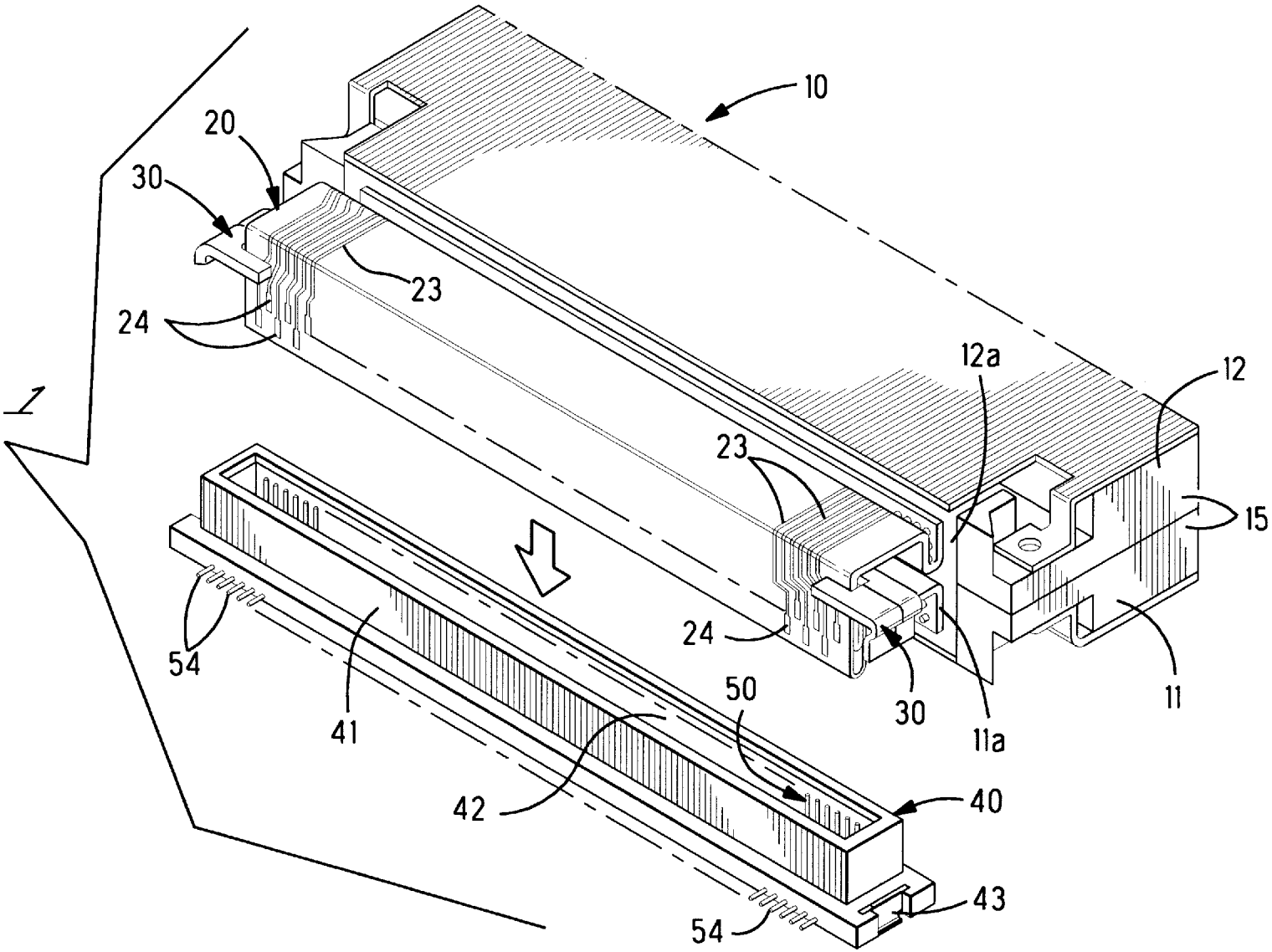
FIG. 1 is an isometric view of an electrical connector assembly according to a preferred embodiment of the present invention.
Figure 2A:
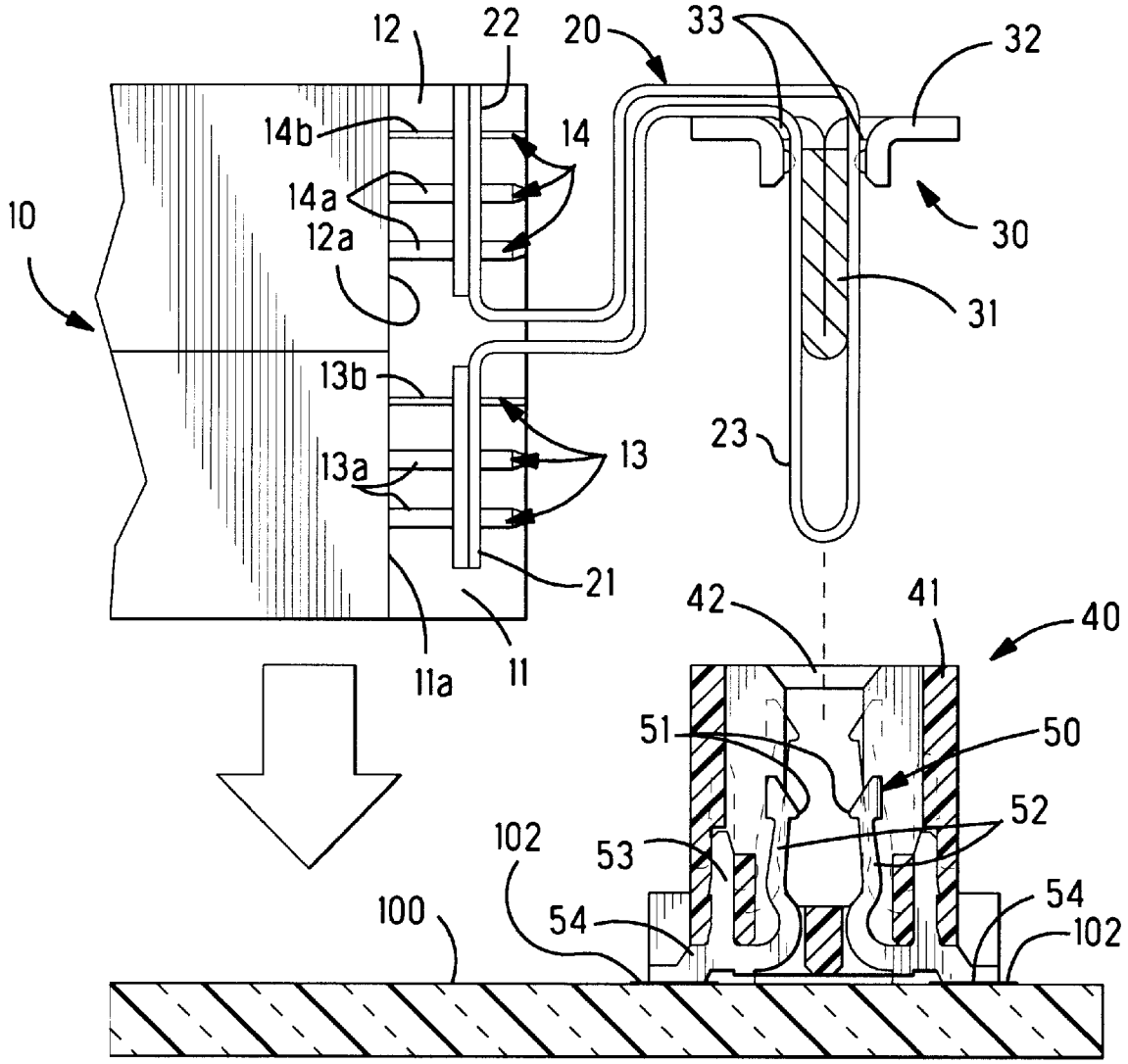
FIG. 2A is a side view of the electrical connector assembly shown in FIG. 1 prior to mating with the corresponding connector.
Figure 2B:
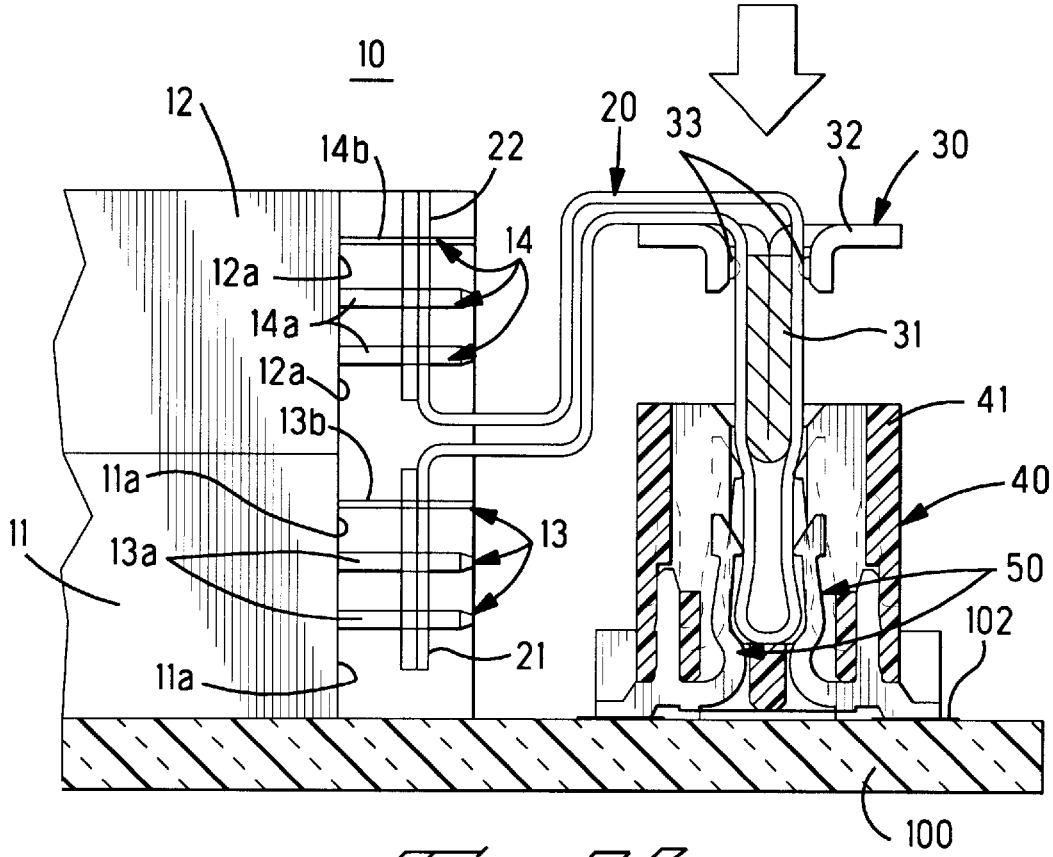
FIG. 2B is a side view of the electrical connector assembly shown in FIG. 1 at a starting time for mating with the corresponding connector.
Figure 2C:
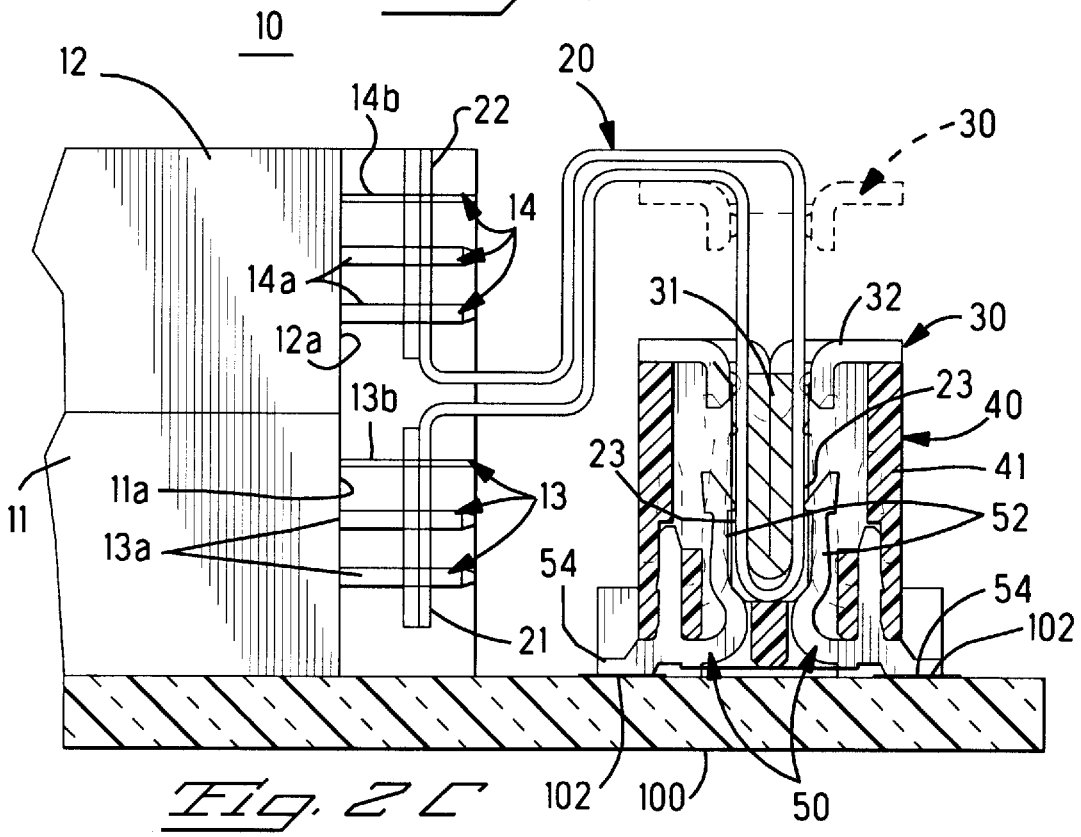
FIG. 2C is a side view of the electrical connector assembly fully coupled with the corresponding connector.

FIG. 1 is an isometric view showing a major part of an embodiment of the present invention adapted to an electrical connector assembly, such as a memory card connector 10. FIGS. 2A through 2C show a process for inserting and connecting the memory card connector 10 of FIG. 1 to a mating connector 40 disposed on and connected to a main substrate 100. That is, FIG. 2A shows a situation where the memory card connector 10 and the mating connector 40 are separated from each other. FIG. 2B shows the memory card connector 10 partially inserted in the mating connector 40. FIG. 2C shows the memory card connector 10 fully mated with the mating connector 40.

As appreciated from FIGS. 1 and 2, the memory card connector 10 of the specific embodiment comprises two stacked connector housings 11, 12. Plural rows of contacts 13, 14 project from wall surfaces 11*a*, 12*a* of these housings 11, 12. In these Figures, the plurality of contacts 13, 14 are two rows of signal contacts 13*a*, 14*a* and one row of ground contacts 13*b*, 14*b*. As appreciated from the above mentioned U.S. Pat. No. 5,324,204, these housings 11, 12 comprise, at front surfaces thereof, a memory card, or a plastic or a metallic plate holder for receiving the HDD (not shown in the FIGS. 1, and 2), respectively.

An FC 20 having sufficient length is connected to each contact 13, 14 of the connector housings 11, 12 at both ends 21, 22 of the conductive traces of the FC 20 by means of solder etc. to conventional pads with through holes to form a card bus. A plurality of conductive traces 23 having contact pads 24 are formed on an outer surface of the FC 20.

A guide member 30 is inserted into a middle portion of the FC 20 to bend it in a U-shape. The guide member 30 is preferably formed by stamping and bending a conductive metal plate in a traditional manner. As best seen in FIG. 2A–2C, the guide member 30 has an insertion portion 31 formed by folding the metal plate to be inserted between rows of contacts 50 of a mating connector 40 as hereinafter explained, and am actuation portion 32 generally perpendicular to the insertion portion and having a generally planer surface. The actuation portion 32 is provided with a slot 33, having a width corresponding to the FC 20, for receiving side edges thereof. The FC 20 is inserted in the slot 33 with a generally U-shape along an outer surface of the insertion portion 31.

The receptacle type mating connector 40 has an elongate box-shaped housing 41 to be mounted on the main substrate 100. The housing 41 has an opening 42 at an upper surface thereof, and has a plurality of surface mounted type (SMT) contacts 50 disposed and secured at both sides of the opening 42. The housing 41 has metal mounting fixtures 43 at both ends in the longitudinal direction of the housing 41, and preferably the connector housing 41 is soldered and secured on a conductive layer (not shown) on the main substrate 100.

Each of the contacts 50 of the connector 40 includes a resilient contact beam 52 having a contact surface 51 near the front end thereof, a mounting portion 53 to be inserted and secured in a contact receiving opening of the housing 41, and a connecting portion 54 to be surface mounted to conductive pads 102 on the main substrate 100. Preferably, a length of the resilient contact beam 52 is selected in various different lengths, and disposed in staggered relationship to achieve high density disposition. As seen from FIGS. 2A, the contact surf ace 51 of each contact 50 projects into the opening 42 of the housing 41.

In a condition in which the memory card connector 10 is not mated or connected to the corresponding connector 40, that is, in the situation shown in FIG. 2A, the contact pad portion of the FC 20 is bent in a generally U-shape. Accordingly, as shown in FIG. 2B, the U-shaped FC 20 can be easily inserted into the housing 41 with low insertion force and essentially without engaging the contacts 50. Finally, as shown in FIG. 2C, when the insertion portion 31 of the guide member 30 is inserted into the opening 42 of the corresponding connector 40 the U-shaped portion of the FC 20 formed with contact pads 24 is forced outwardly from inside to urge and expand outwardly the contact beams 52 of the contacts 50. Therefore, the contact pads 24 of the FC 20 of the conductive traces 23 are forced and engaged with the contact surfaces 51 of the contacts 50, thereby interconnecting the contacts 13, 14 of the memory card conductor 10 to the contacts 50 of the mating connector 40, further interconnecting between pads 102 on the main substrate 100.

If the FC 20 is formed with a ground conductive layer on an inner surface thereof, the insertion portion 31 of the guide member 30 engages the conductive layer. Although it is not shown, the guide member 30 is preferably engaged with the mounting metal fixture 43 of the housing 41 at the both ends in the longitudinal direction of the guide member 30 to electrically engage the ground conductive layer of the FC 20.

As is readily appreciated from a comparison between the connectors 10, 40 of the FIGS. 2A through 2C and the conventional memory card connector disclosed in the above described U.S. Pat. No. 5,324,204, the electrical connector assembly of the present invention replaces the plurality of L-shaped contacts disposed in staggered relationship of the prior art connector with the FC 20 and the corresponding connector 40. In accordance with the connector of the present invention an easily handled and a highly sense arrangement corresponding to the conductive traces of the FC 20 is achieved because of elimination of plural rows of the deformable and high density L-shaped contacts. Further, an important matter is that length of the-signal traces from contracts 13, 14 of the housings 11, 12 to the contacts 50 of the mating connector 40 can be formed such that the length is essentially constant. Accordingly, since even in high speed data signals it is possible to make signal transmission time or signal delay constant, the present connector is suitable for a card bus for transmitting high speed and high frequency signals. Further, since the memory card connector 10 is detachably connected to the connector 40 mounted on the main substrate, it should be noted that the termination assembly of the connector and serviceability are substantially improved.

Figure 3:
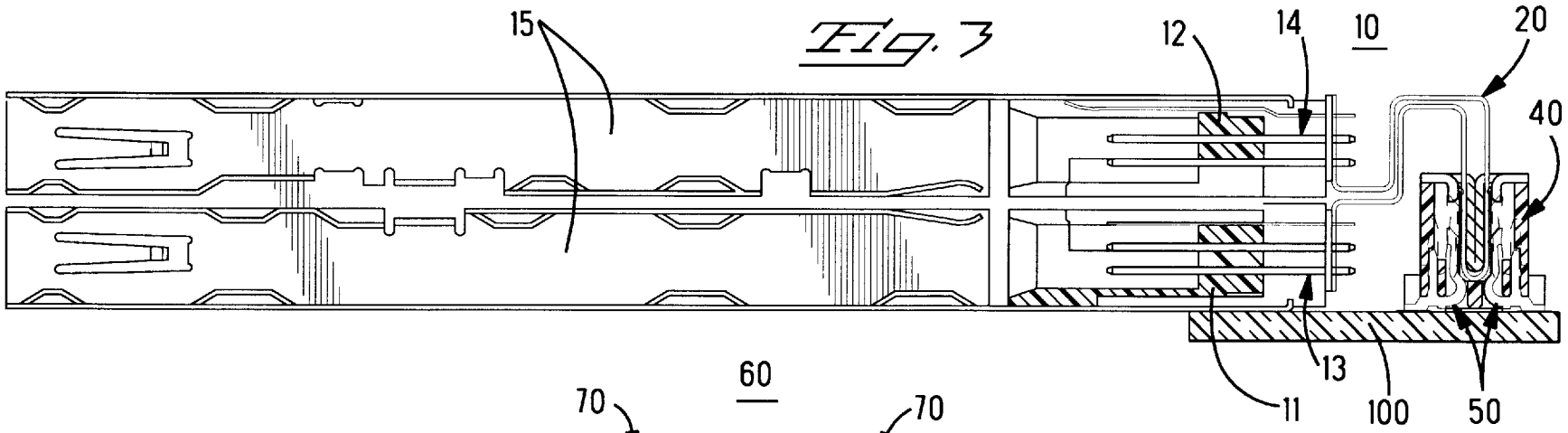
FIG. 3 is a cross-sectional side view where the electrical connector assembly according to the present invention is adapted to a stacked memory card connector.

FIG. 3 is a cross-sectional view showing entire memory card connector 10, of the present invention, including a memory card retention portion 15. The memory card retention portion 15 of the memory card connector 10 is formed by bending a thin metal sheet. In the preferred embodiment of the electrical connector assembly shown in FIG. 3, the connector housings 11, 12 are in a stacked arrangement with the respective contacts 13, 14 overlying each other. However, the present invention is not limited to such an embodiment, for example, the present invention can be applied to a card bus for interconnecting contacts on wall surfaces of a pair of housings disposed in opposite relationship.

Figure 4:
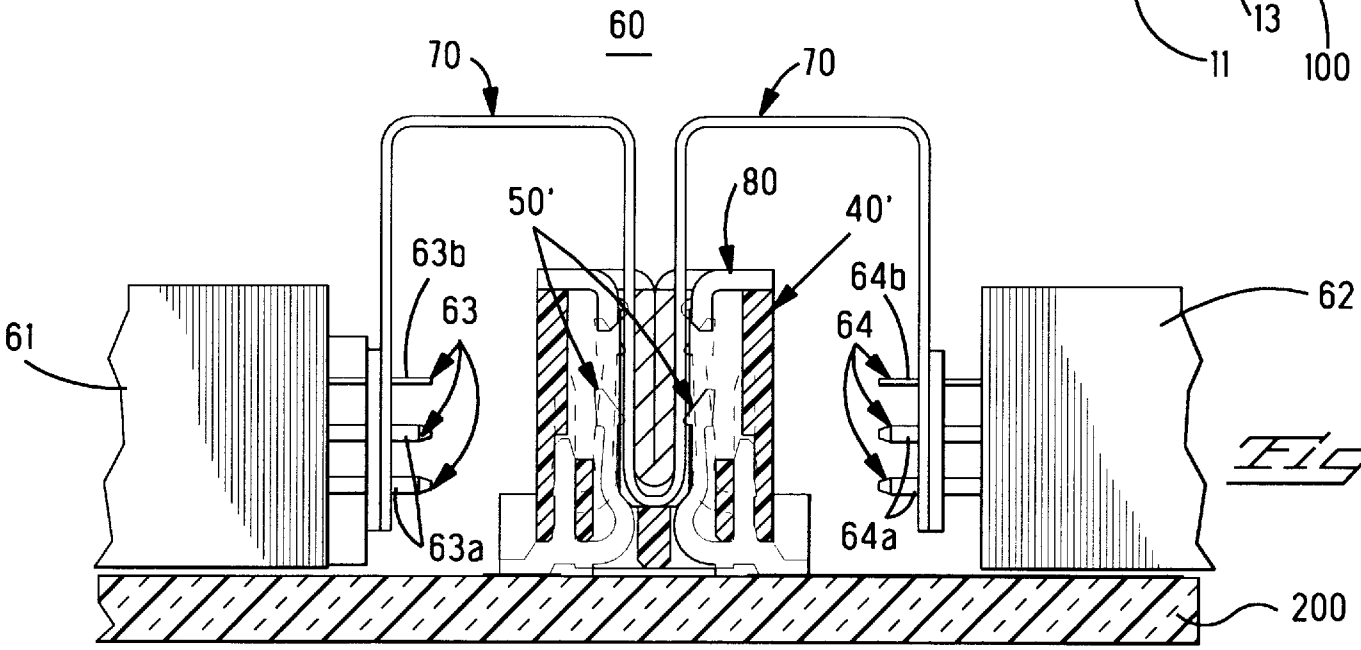
FIG. 4 is a partial model view of another embodiment of the electrical connector assembly according to the present invention.

Another such embodiment of an electrical connector 60 is show in FIG. 4. Electrical connector assembly 60 comprises a pair of separate docking connectors or memory card connectors 61, 62. Each of the connectors 61, 62 opposes each other at a wall surface thereof and preferably includes plural rows of multiple number of contacts 63, 64, including signal contacts 63*a*, 64*a* and ground contacts 63*a*, 64*b*. Between both connectors 61, 62 is a mating connector 40' soldered on a main substrate 200. The mating connector 40' can be essentially similar to the mating connector 40 shown in FIGS. 1 through 3. A FC 70 is connected to the contacts 63, 64 at one end of the conductive traces thereof on the walls of the both connectors 61, 62 by means of a prior art technique. A middle portion of the FC 70 is inserted into a slot of a guide member 80. Contact pads (not shown) at the middle portion of the FC 70 are forced by the guide member 80 into an opening of the connector 40' to engage contacts 50' disposed at both sides of the opening to establish interconnection.

Figure 5:
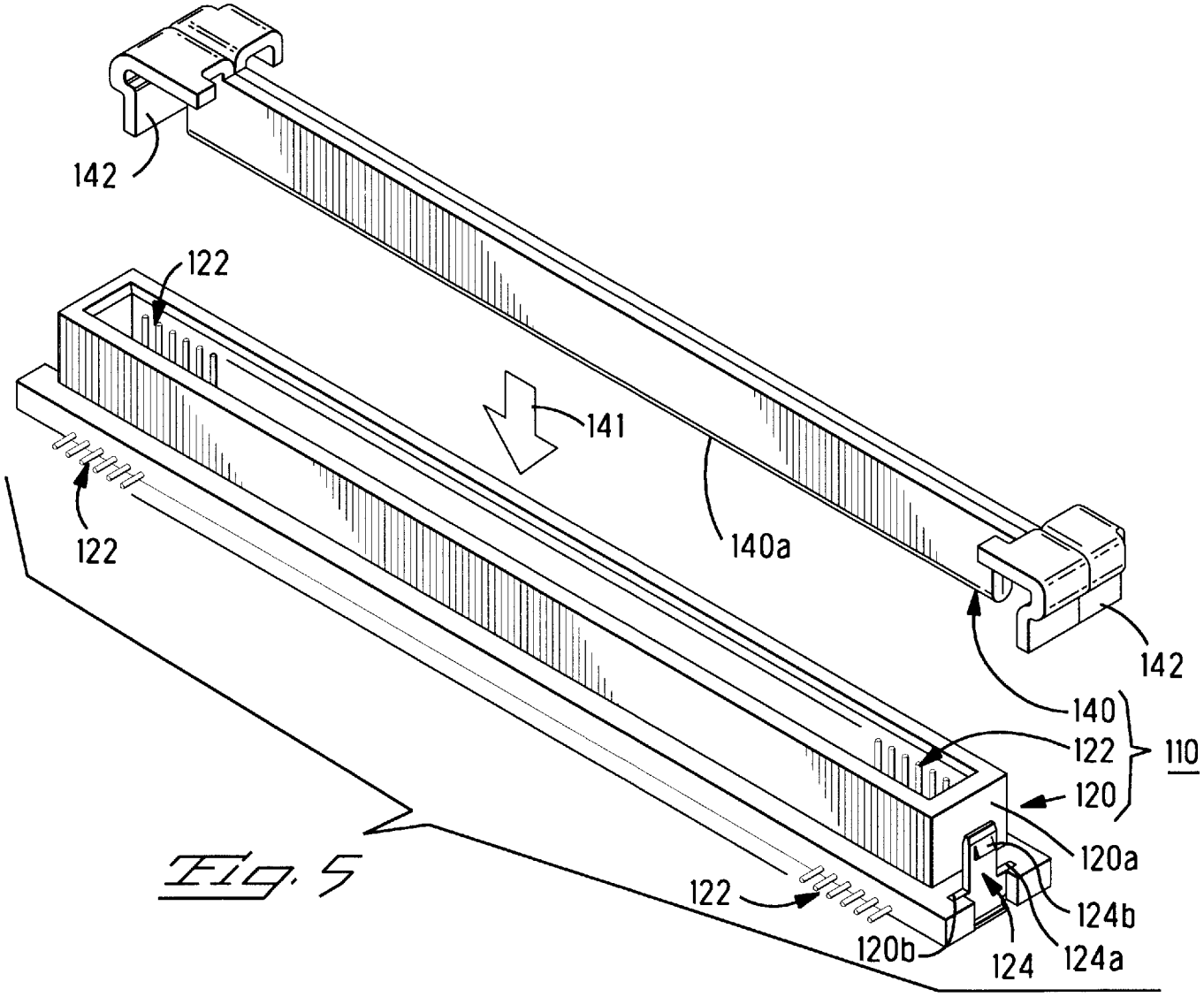
FIG. 5 is an isometric view of the electrical connector assembly of another embodiment according to the present invention.
Figure 6:
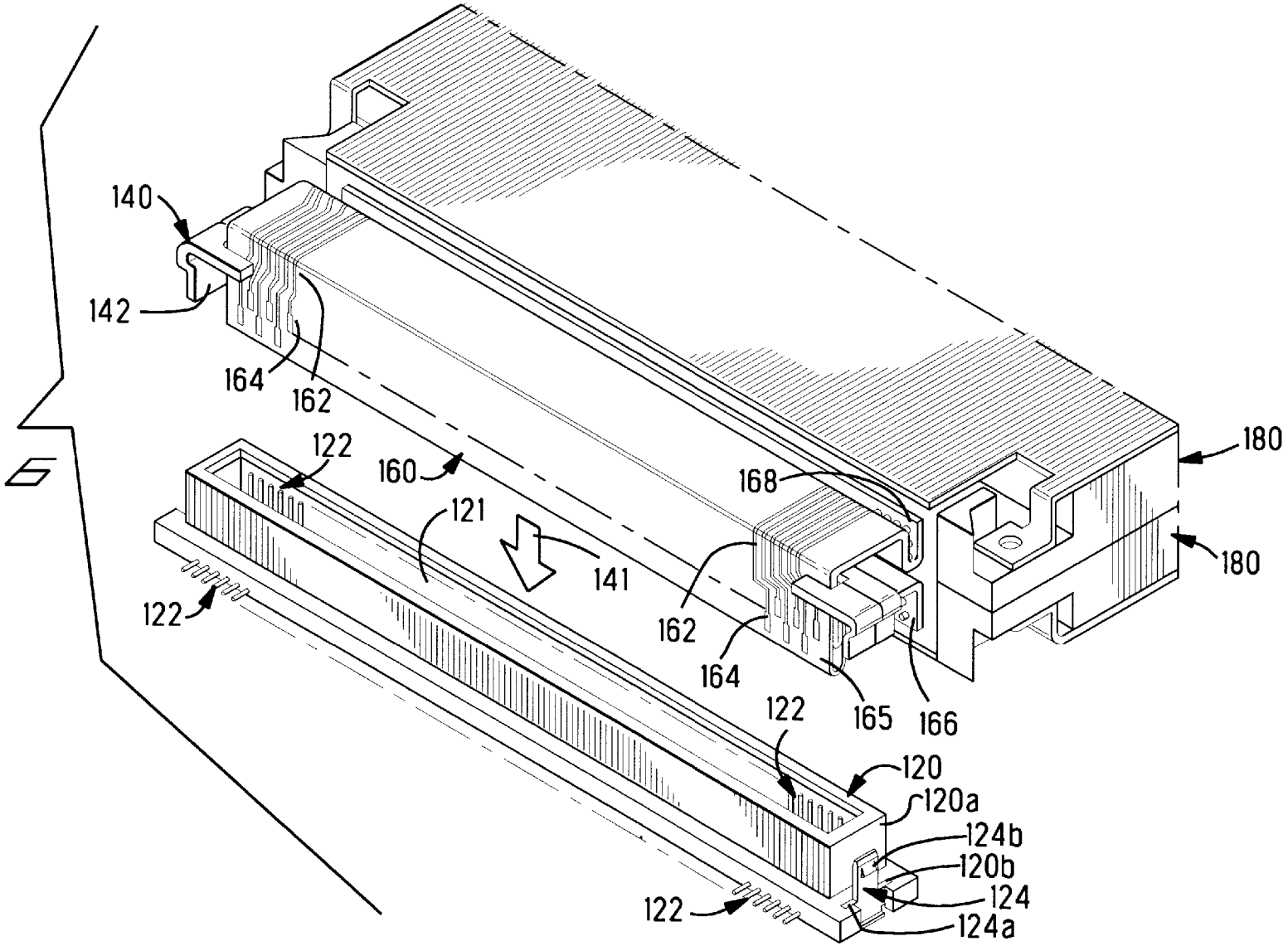
FIG. 6 is an isometric view showing a situation where the guide member in the electrical connector assembly shown in FIG. 5 is mounted in a flexible printed circuit board connected to the memory card connector.

With reference to FIGS. 5 through 12, another embodiment of an electrical connector of the present invention will be described. FIG. 5 is an isometric view of the electrical connector of the another embodiment. FIG. 6 is an isometric view in which the guide member to be used for the electrical connector is positioned on the FC that is connected to the memory card connector. FIGS. 7A–C and 8A–B show a housing of the electrical connector shown in FIG. 5. FIGS. 9A–C and 10A–B show the guide member of the electrical connector shown in FIG. 5.

Figure 8A:
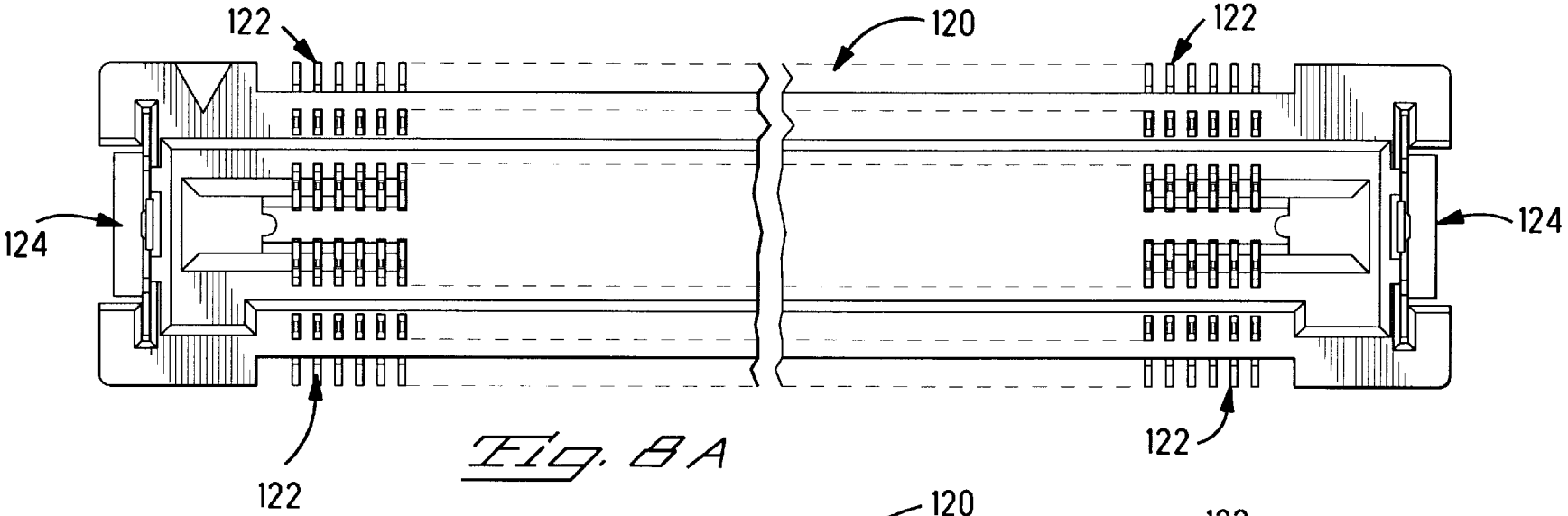
FIG. 8A is a plan view of the housing of FIG. 7A.
Figure 8B:
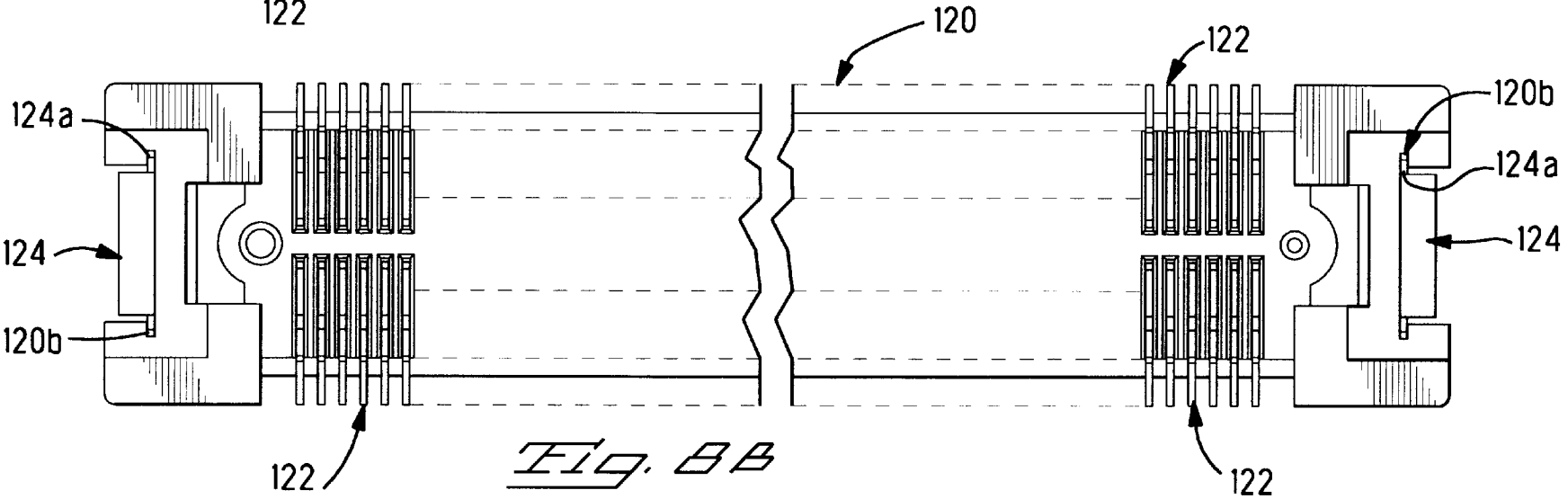
FIG. 8B is a bottom view of the housing of FIG. 7A.
Figure 10A:
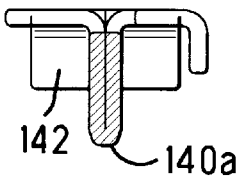
FIG. 10A is a cross-sectional view of the guide member of FIG. 9 taken along the line 10A—10A of FIG. 9A.
Figure 10B:
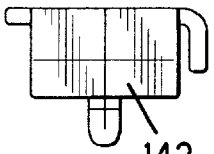
FIG. 10B is an end view of the guide member of FIG. 9A–C.
Figure 9A:
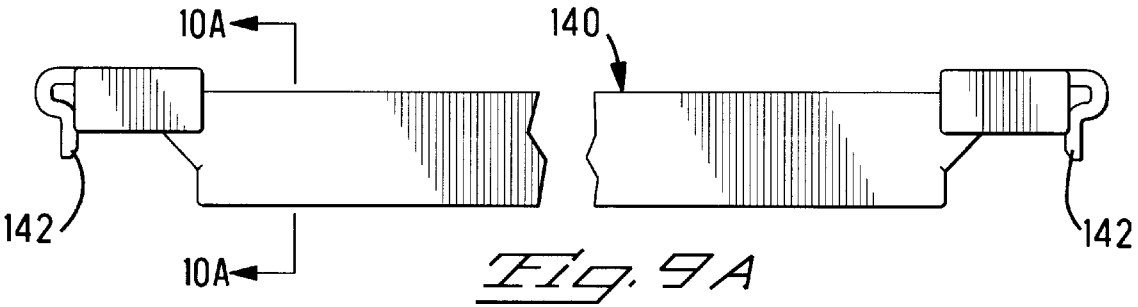
FIG. 9A is a front view of a guide member of the electrical connector assembly shown in FIG. 5.
Figure 9B:
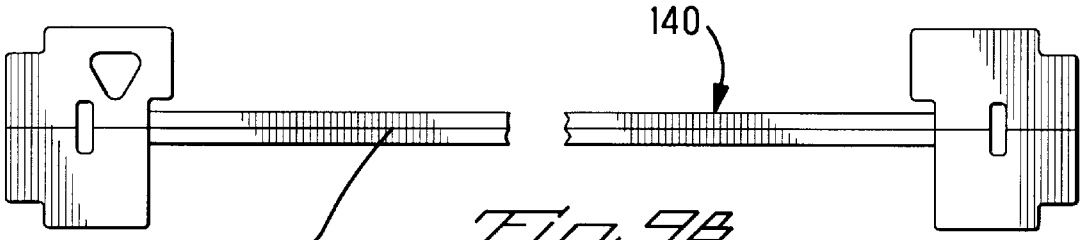
FIG. 9B is a plan view of a guide member of the electrical connector assembly shown in FIG. 5.
Figure 9C:
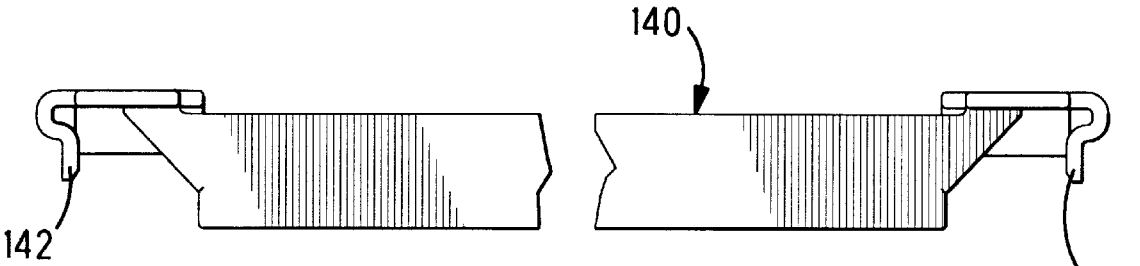
FIG. 9C is a rear view of a guide member of the electrical connector assembly shown in FIG. 5.

An electrical connector 110 is provided with a housing 120 having an opening 121 for receiving an FC 160, a plurality of contacts 122 opposedly disposed in two rows in the housing 120, and a guide member 140 for forcing and securing the FC 160 inserted into the housing 120. Plate-like ground conductive members 124 are provided on both end surfaces 120*a* of the housing 120 by pressing side portions 124*a* into slots 120*b* in the housings 120 to engage projections (not shown) formed at side portions 124*a* with the housing 120 as shown in FIG. 8B. When the guide member 140 is moved in the direction of arrow 141, as will be described hereinafter, to be inserted into the housing 120, a ground portion 142 of the guide member 140 engages the projections 124*b* of the conductive ground members 124. As the conductive ground member 124 is mounted and connected on the substrate (not shown), the mounting strength of the housing 120 to the substrate is enhanced. A plurality of contacts 122 disposed in the housing 120 are engaged, respectively, with the conductive pads 164 of the signal traces 162 formed on the FC 160.

As shown in FIG. 6, the FC 160 is bent at a middle portion 165 and end portions 166, 168 of the FC 160 are connected to corresponding contacts of a memory card connector 180. A share of the FC 160 is schematically shown in FIGS. 11A–B and 12A–C. The FC 160 is continuously bent at the middle portion 165 thereof to form two wiring portions or arrays 170, 172. The wiring portions or arrays 170, 172 are formed with signal traces 162 shown in FIG. 6 and conductive pads 164 on both surfaces 170*a*, 172*a* of the wiring portions 170, 172. Also, the wiring portions 170, 172 are formed with a ground conductor or ground wiring at back surfaces 170*b*, 172*b*, respectively, such as described below with reference to FIGS. 13–18. The ground wiring or conductor preferably is formed on entire back surfaces 170*b*, 172*b* or, alternatively, may be formed only on a portion thereof.

The guide member 140, as shown in FIGS. 9A–C and 10A–B is, for example, integrally formed by stamping and bending a sheet of metal made of copper alloy such as phosphorous copper, and is formed with the above described ground portions 142 at both end portions of the guide member 140. Upon forming the guide member 140, the stamped metallic sheet is bent at the middle portior 140*a* and is outwardly bent at the end portions. The end portions are bent downwardly to form the ground portions 142. The ground portions 142 have resiliency, thereby gripping the housing 120 from both sides when assembled thereto. The guide member 140 is disposed between the wiring portions or arrays 170, 172. Until the guide member 140 is inserted into the housing 120, the guide member 140 is preengaged with projections 191 (see FIGS. 11 and 14) formed on the FC 160.

Figure 11B:
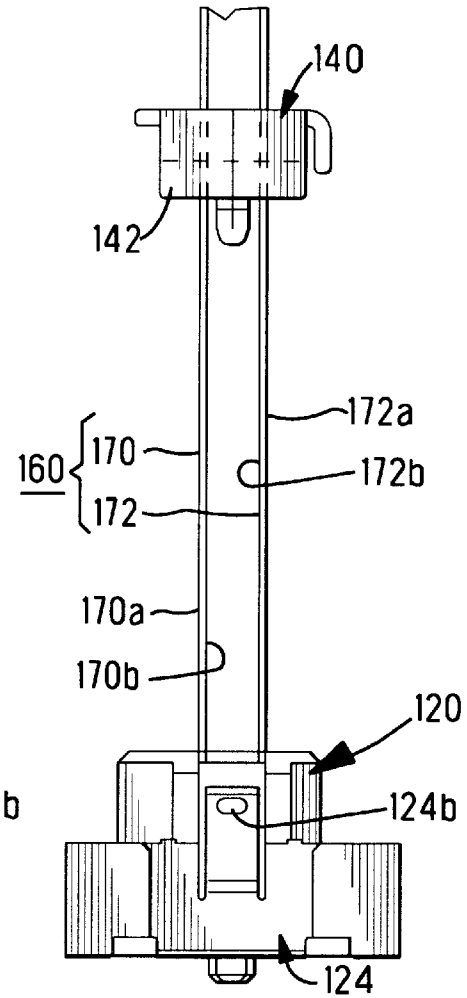
FIG. 11B is a side view of the flexible circuit inserted in the electrical connector assembly of FIG. 11A.
Figure 11A:
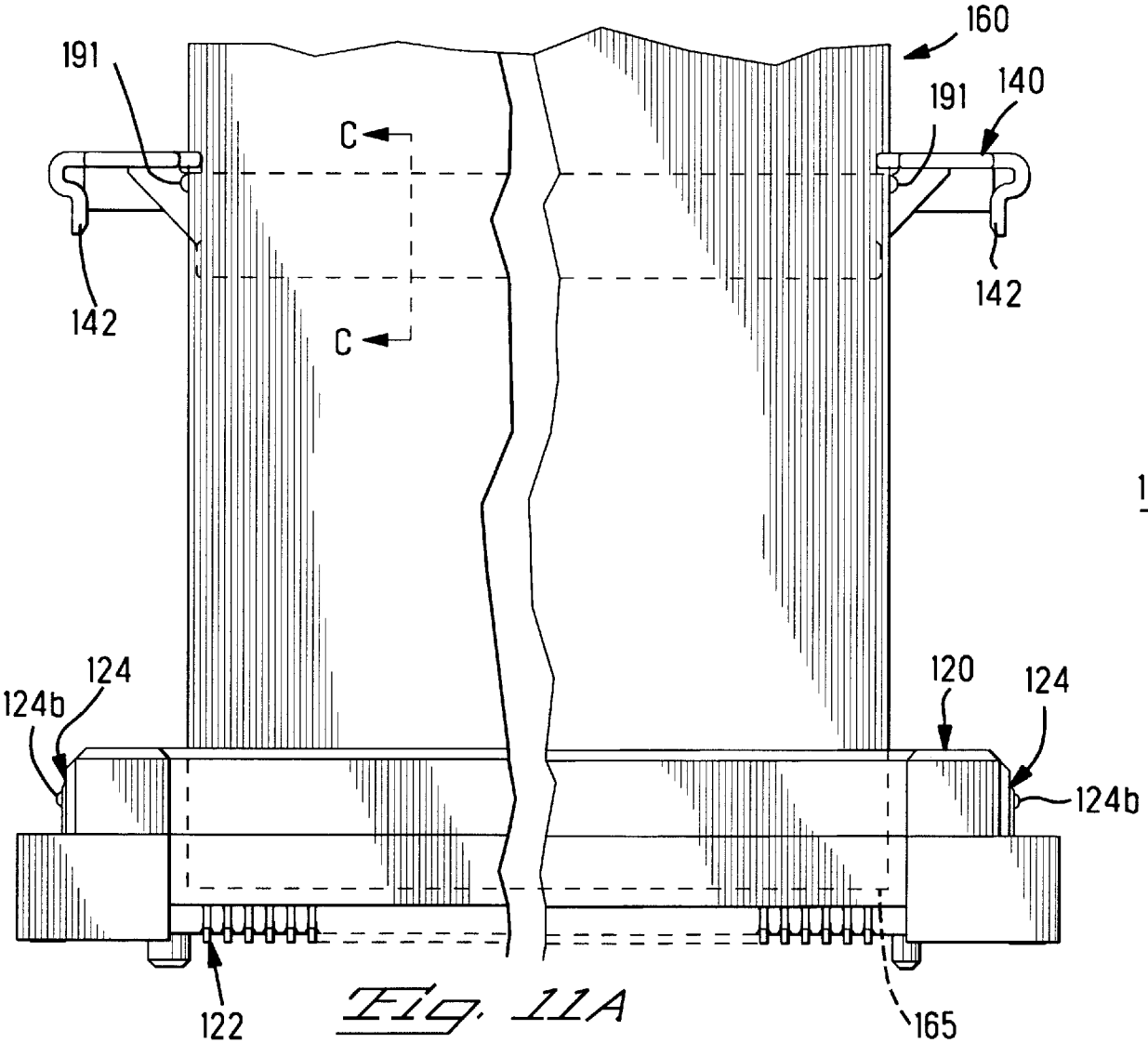
FIG. 11A is a front view of a flexible circuit inserted in an electrical connector assembly.
Figure 12C:
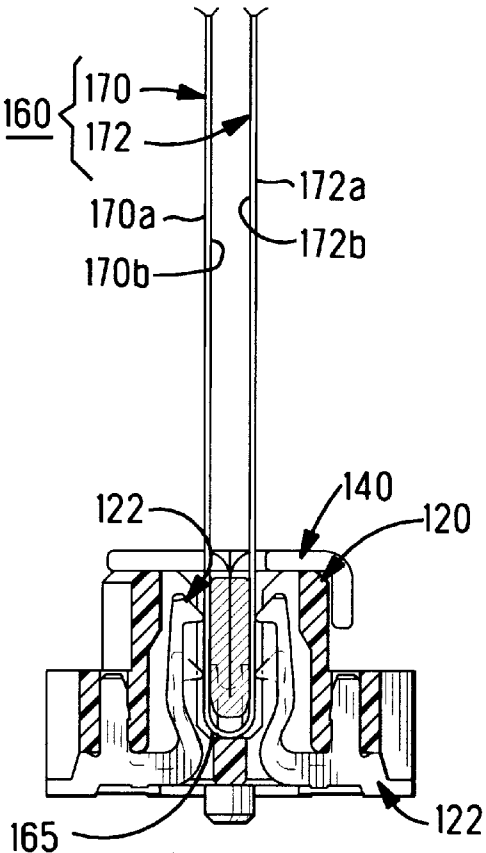
FIG. 12C is a cross-sectional view showing the flexible circuit secured by the guide member in the connector housing.
Figure 12B:
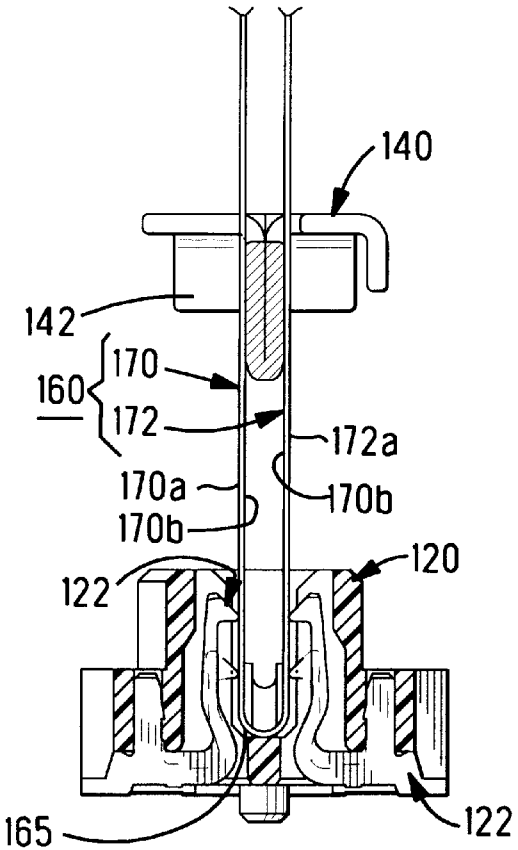
FIG. 12B is a cross-sectional view showing a guide member of the electrical connector assembly disposed between the U-shaped flexible circuit with the U-shaped end of the flexible printed circuit board inserted into the connector housing.
Figure 12A:
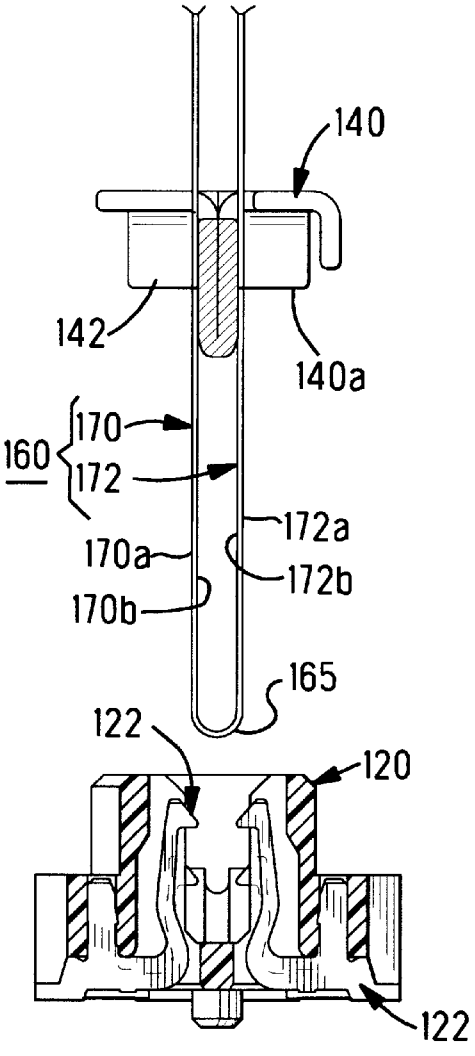
FIG. 12A is a cross-sectional view showing a guide member of the electrical connector assembly disposed between the U-shaped flexible circuit prior to inserting the flexible circuit into a connector housing.

Now, with reference to FIGS. 11A–B and 12A–C, a sequence will be described in which the FC 160 is inserted into the housing 120 and is secured by means of the guide member 140. In order to secure the FC 160 in the housing 120 by the guide member 140, first, as shown in FIG. 12A, the guide member 140 is disposed at a position spaced apart from the middle portion 165 of the FC 160. Then, as shown in FIGS. 11A–B and 12B, the middle portion 165 of the FC 160 is inserted into the housing 120. After inserting the middle portion 165 of the FC 160 into the housing 120, as shown in FIG. 12C, the guide member 140 rides over the projections 161 of the FC 160 to be inserted into the housing 120, and the middle portion 165 of the FC 160 inserted into the housing 120 and is forced into position by the guide member 140. Accordingly, the ground wiring formed on the back surfaces 170*b*, 172*b* of the FC 160 are positively engaged with the guide member 140, and, additionally the ground portions 142 of the guide member 140 engage the projections 124*b* of the ground conductive member 124, as described above. The guide member 140 is made of metal, thereby eliminating deformation or breaking of the guide member when the guide member 140 is inserted into the housing 120. Accordingly, the conductive pads 164 (see FIG. 6) can be readily and firmly engaged with the contacts 122 more easily than can a plastic cover or guide member, thus enabling excellent reliability and easy operation. Further, in the situation in which the metallic guide member 140 is inserted into the housing 120, the guide member 140 engages both the ground conductive members 124 secured in the housing 120 and the ground conductor or wiring (not shown) on the FC 160, the guide member 140 also functions as a around member.

Figure 13:
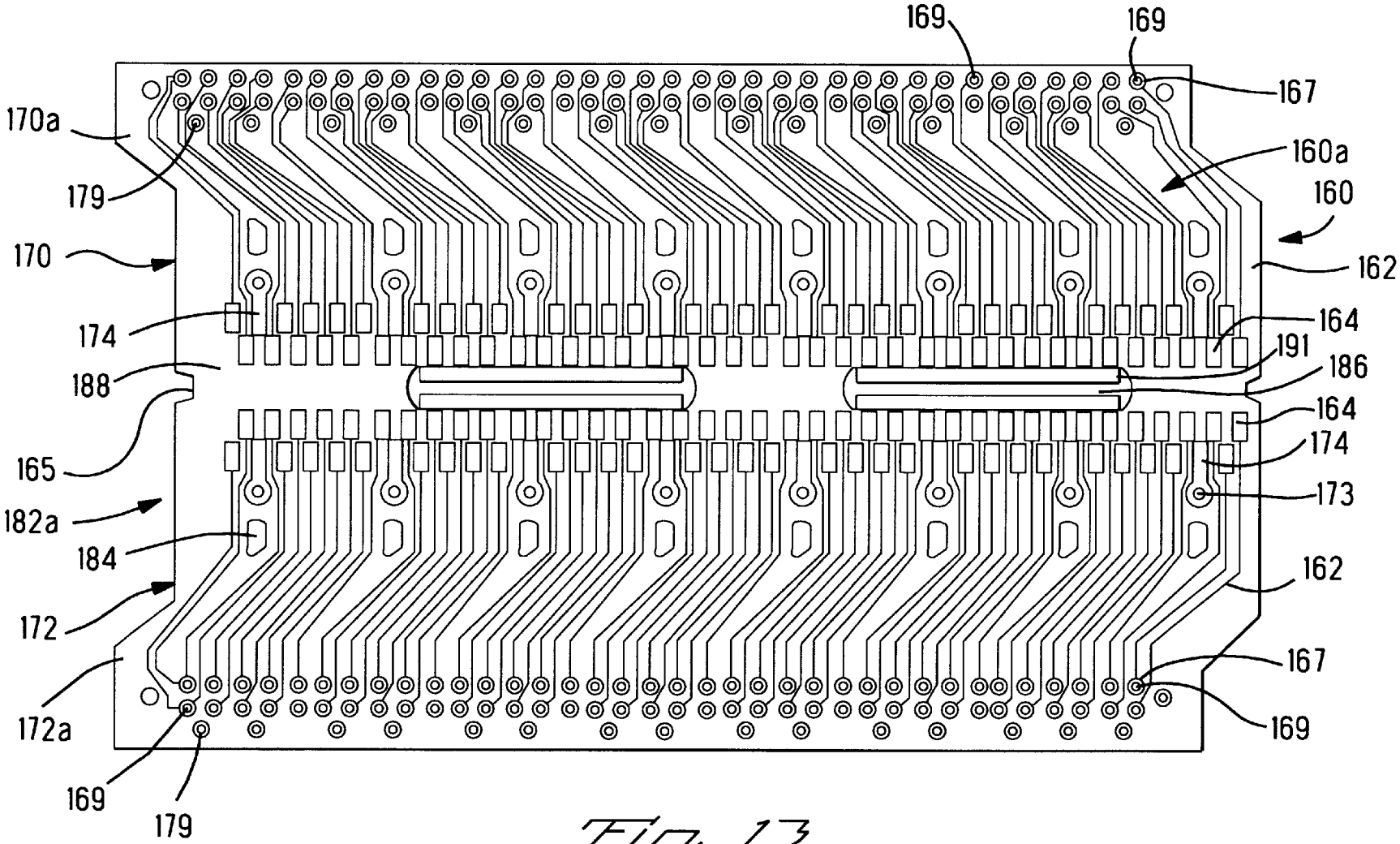
FIG. 13 is a plan view at one surface of the FC according to the present invention.
Figure 14:
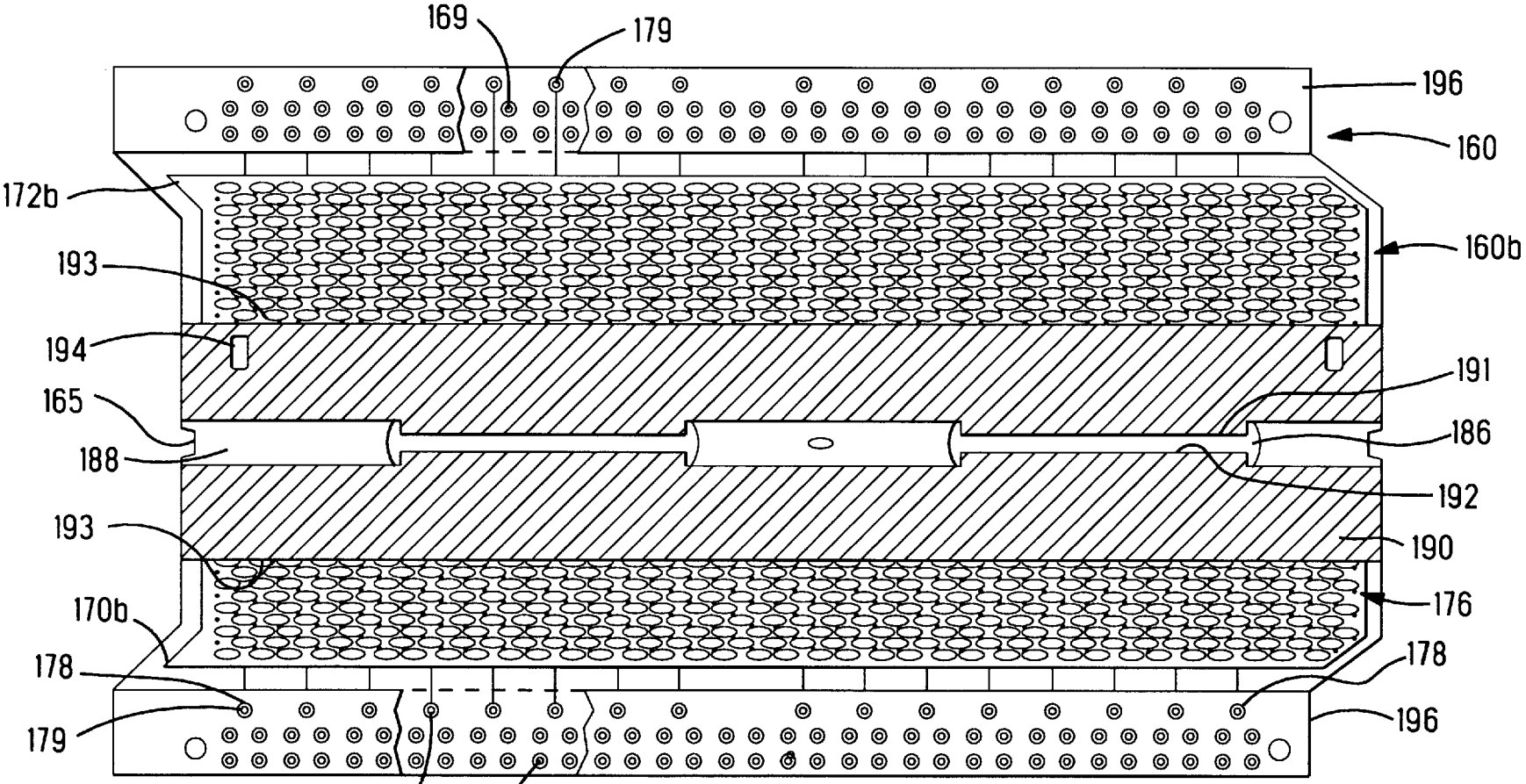
FIG. 14 is a bottom view of the reverse surface of the FC in FIG. 13.
Figure 15:
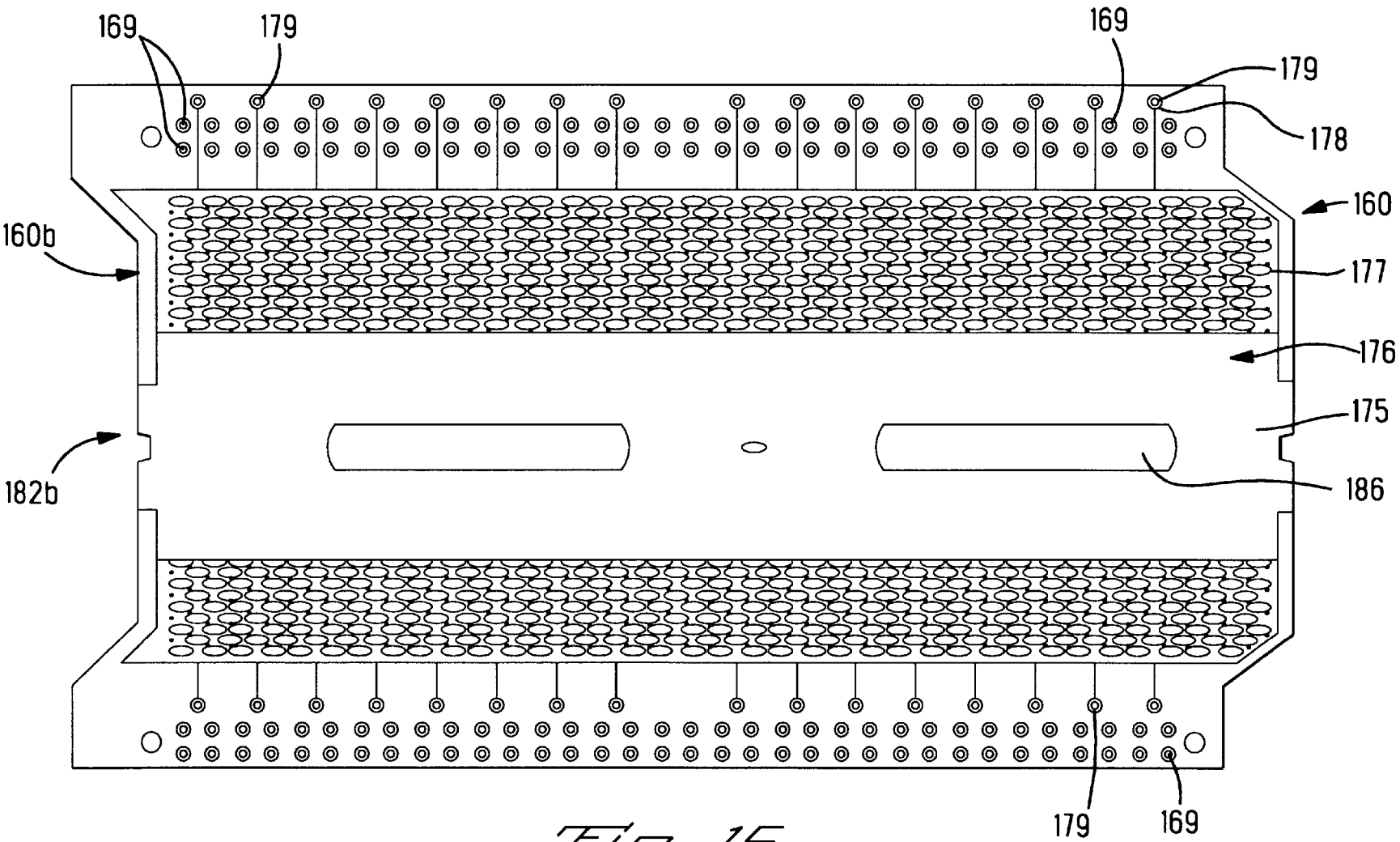
FIG. 15 is a view similar to FIG. 14 prior to adhering the strengthening plates.
Figure 16:
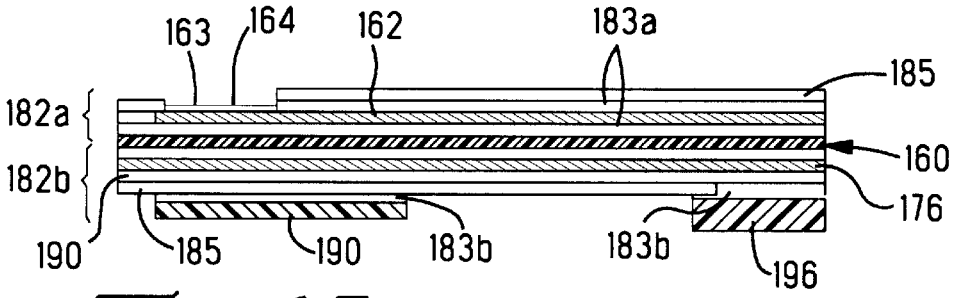
FIG. 16 is a magnified cross-sectional view of the FC in FIG. 1.

A preferred embodiment of the FC 160 in accordance with the present invention is illustrated in FIGS. 13 through 16. FIG. 13 shows one surface 160*a* of the FC 160 while FIG. 14 shows the reverse surface 160*b* thereof. Also shown in FIG. 15 is the surface 150*b* before adhering strengthening plates 190, 196, which will be described hereinafter. Furthermore, FIG. 16 shows an enlarged cross-sectional view in the thickness direction from the slat to the edge portion.

As shown in FIG. 16, the FC 160 is formed as a multi-layer structure. A central film 182 of polyamide or the like separates one side structure 182*a* to form the surface 160 and a reverse side structure 182*b* to form the surface 160*b*. Each structure 182*a*, 182*b*, is made by an electrically conductive film of copper or the like and a cover layer 185 of polyamide or the like adhered on the surface of the central film 182 by adhesive material 183*a*, 183*b*. The electrically conductive film is further etched to form conductive patterns 162 and a ground layer 176, which will be described hereinafter.

As shown in FIGS. 13 and 16, the structure 182*a* on surface 160*a* of the PC comprises conductive arrays 170, 172, having conductive pads 164, including conductive traces 162, connection portions 167 connected to conductive traces 162, and through-holes 169 extending to the other surface 160*b*. Each conductive trace 162 interconnects the respective conductive pads 164 and connection portion 167. As best shown in FIG. 16, the conductive pads 164 have a gold or solder plating layer 163. The pads 164 are arranged in corresponding positions to the connector contacts, such as in connector 110 shown in FIGS. 5–12, to receive the FC 160 and are staggered in the particular embodiment shown in FIG. 13. Note that ground contact pads 174 are mixed in the rows of the conductive pads 164 as shown in FIG. 13. The ground contact pads 174 are disposed at locations to engage with desired contacts in the connector. Also, the ground contact pads 174 are electrically connected to a ground layer 176 to be described hereinafter by way of via holes 173 extending in the direction of the thickness of the FC. The connection portions 167 formed at the edge portions of the FC 160 are in a ring form to be soldered to the contacts of a PC card connector and are formed with through-holes 169 as mentioned above.

Figure 18:
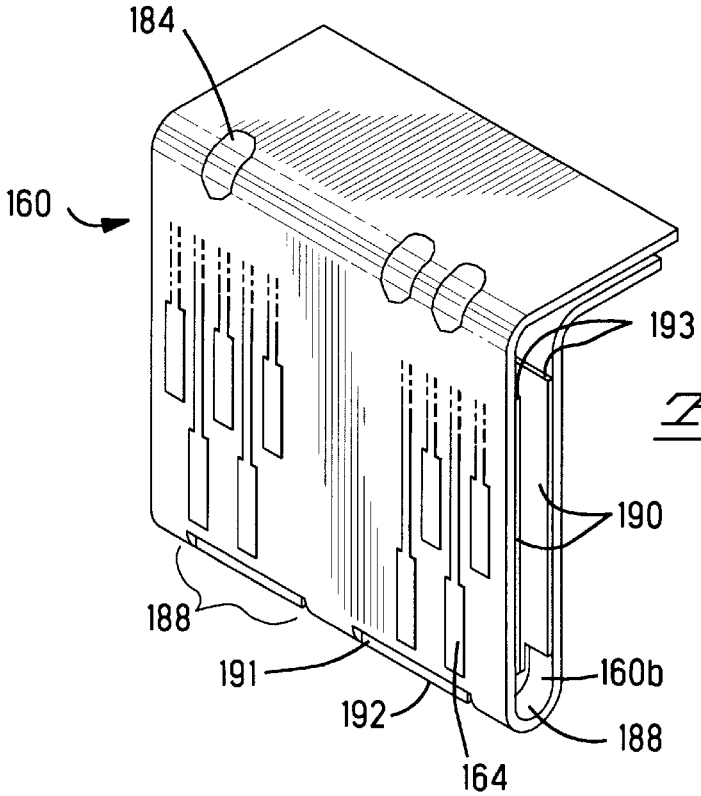
FIG. 18 is an isometric view of the FC in FIG. 13 showing how it is folded or bent when inserted into a connector.

The structure 182*a* on surface 160*a* also includes a plurality of recesses 184 that extend into the cover layer 185 and are formed by partly removing the cover layer 185 and are arranged substantially in rows, as seen in FIGS. 13 and 18.

The FC 160 is preferably formed with openings or slots 186 extending therethrough and at substantially center position between the rows of the conductive pads 164. The openings 186 provide the FC 160 with relatively narrow bridge or belt-like portions 188 therebetween.

As best shown in FIGS. 14 through 16, the reverse structure 182*b* on surface 160*b* includes the ground layer 176 and connection portions 178. The ground layer 176 includes a plate portion 175 and mesh portions 177. The plate portion 175 comprises an electrically conductive film of copper or the like extending in two dimensions while the mesh portions 177 are formed by etching the electrically conductive film in a slanted mesh as shown in FIG. 14 through 15. Also, the ground layer 176 extends from the edges of the meshed portions 177 to the edges of the FC 160 for connection to the connection portions 178 that are substantially similar configuration as the above mentioned connection portions 167. The connection portions 178 receive ground connection terminals of the PC card connector at the through-holes 179 extruding to the surface 160*a* for making solder connections to contacts of a connector (not shown).

The FC 160 further includes first and second plastic strengthening plates 190, 196 made from glass-filled epoxy resin or the like that are adhered on the surface 160*b* as shown in FIG. 14. The first strengthening plates 190 are positioned at both sides of the openings 186 as a pair and at the immediate reverse side of the conductive pads 164. Note that the first strengthening plates 190 include opposed edges 192, 193 with edge 192 having projections 191 that extend into the openings 186 when the first strengthening plates 190 are adhered. The edges 192 are parallel with the openings 186. As shown in FIGS. 14 and 15, the first strengthening plates 190 substantially cover the plate portion 175. Also, at least one of the pair of the first strengthening plates 190 is formed with engaging slots 194 or projections 191 to be used preliminary for retaining the FC 160 to guide member 140 when it is inserted into the connector, as previously described with reference to FIG. 11.

Additionally, the second strengthening plate 196 is adhesively secured at the locations of the connection portions 167, 178 using adhesive material 183*b* such as a liquid solder resist. This makes it easy to solder the connector to the PC card connectors. The second strengthening plate 196 has through-holes at location corresponding to the connection portions 167, 178.

Figure 17:
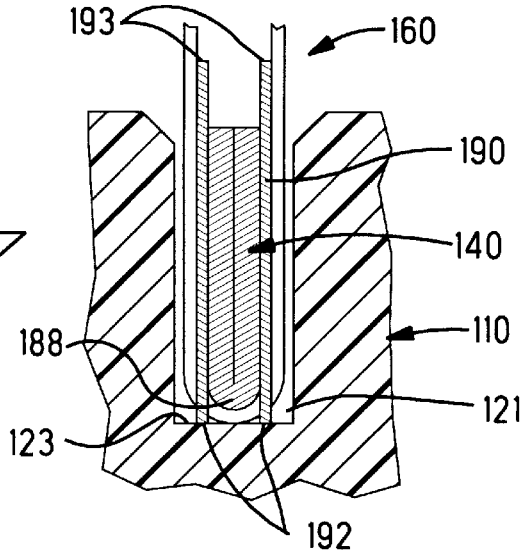
FIG. 17 is a simplified cross-sectional view of the FC in FIG. 1 as inserted into a connector.

A cross-sectional view of the FC 160 according to the present invention as inserted into the connector 110 having a FC receiving opening 121 is shown in FIG. 17. The FC 160 is folded at the bridge portions 188 with the conductive pads 164 facing outwardly.

A guide member or guide member 140 is used to insert the FC 160 into the FC receiving slot 121. As shown in FIG. 18, the FC 160 is bent at a substantially rivet angle along the recesses 184 and the reverse surface 160*b* near the edges 193 of the first strengthening plates 190. In the inserted portion, the edges 193 of the first strengthening plates 190 abut against the bottom surface 123 of the FC receiving opening 121. This provides precise alignment of the conductive pads 164 with contact points of contacts (not shown) in the connector 110, thereby assuring reliable interconnection therebetween.

It is to be understood that the shown in FIGS. 1 through 4 may be modified to include the support plates 190, as shown in FIG. 18 and additional plates 196 (not shown). The support of reinforcing plates 190 protects the inner surface of the FC.

While a plurality of exemplary embodiments of the electrical connector assembly according to the present invention has been described herein, it is not intended that this invention be limited to the embodiments. It will be appreciated by those skilled in the art that various modifications can be made for specific applications without departing from the scope and spirit of the invention. For example, the recesses 184 may not be limited to the particular shape but may have a constricted portion along the outer periphery or may have wider portions. The strengthening plates 190 nay not be limited to plastic material but may be replaced by metal plates.

The electrical connector assembly according to the present invention, as appreciated from the above description, provides following various excellent advantages. It is suitable for an application in which an high density electrical connector such as an memory card connector having a plurality of contacts is interconnected to corresponding conductive areas on the printed circuit board. By using the flexible substrate, the right angle contact legs can be eliminated, thus enabling the high density contacts of the connector to be reliably and easily interconnected to the PC board conductive areas without having the problems associated with deformation of the contact legs.

A high density electrical connector assembly is achieved, since the conductive traces or the conductive pads formed at the middle portion of the FC are engaged with a plurality of contacts in one connector and the other ends of the traces are connected to corresponding contacts of at least one conventional FC connector terminated at the ends of the FC.

The electrical connection between the conductive pads and the contacts are established by inserting the guide member into the FC bent in a generally U-shape. Since the guide member is forced between the rows of the contacts, an assured interconnection is provided even for an the FC having sufficiently large width. Further, if a conductive metal guide member is used for the FC having a ground conductor on the reverse side thereof the guide member can be electrically engaged to ground conductive members at one or both ends of the housing. Thus a high density connector assembly for high frequency signals is obtained.

The flexible circuit according to the present invention assures highly reliable electrical connection while maintaining a relatively narrow pitch between contacts by folding it along the relatively narrow bridge portions and by the provision of the strengthening plates abutting against the housing for accurate alignment or registration between the conductive pads and the contacts. Especially, the bridge portions are relatively narrow to permit smooth folding of the FC, thus avoiding undesirable force being applied to the arrays of the conductors thereon.

Furthermore, the provision of the ground layer on the inner surface of the FC and the conductive patterns for transmitting signals on the outer surface effectively reduces crosstalk noise between the conductive patterns.

Additionally, the recesses formed by removing a part of the layers near the bending positions of the FC permit bending of the FC at a desired position and angle.

We claim:

1. An electrical connector assembly including a housing having a plurality of contacts disposed along an elongate opening; a flexible substrate having a width corresponding to the length of the opening of the housing, and having conductive traces on one surface thereof corresponding to the contacts in the housing; and a guide member having a plate portion to be disposed in the flexible substrate which is bent in a generally U-shaped about the plate portion with the one surface outside, and to be inserted into the opening of the housing, the connector assembly being characterized in that:

the housing includes a ground conductive member at least at one end thereof;

the flexible substrate is formed with a ground conductor on the other surface thereof; and the guide member is a conductive member adapted to further provide a connection to ground for the assembly whereby the contacts and the conductive traces are electrically connected by force exerted by the guide member on the flexible substrate and the ground conductor of the substrate is connected to the ground conductive member of the housing by the guide member.

2. The electrical connector assembly of claim 1 wherein the flexible substrate further includes strengthening plates disposed on the other surface thereof at the locations corresponding to the conductive pads.

3. The electrical connector assembly of claim 1 wherein the flexible substrate further includes a plurality of openings formed between the arrays of conductive pads to define relatively narrow bridge portions; and parts of strengthening plate extend into the openings by a predetermined length.

4. The electrical connector assembly of claim 1 wherein the flexible substrate further includes a cover layer disposed over the conductive traces with conductive pads of the traces being free of the cover layer to enable electrical connection thereto, the cover including a plurality of recesses formed substantially in a line thereon at locations where the conductive traces and conductive pads are not formed to facilitate bending of the flexible circuit at a selected location.

5. An electrical connector having a housing, a plurality of contacts exiting the housing at an end, and a flexible substrate being electrically connected to the contacts, the connector comprising:

a first set of contacts included in the plurality of contacts, a second set of contacts being adjacent the first set of contacts and also included in the plurality of contacts, the flexible substrate being connected to the first and second sets of contacts to form a closed loop extending from the end of housing; and, a guide member disposed within the closed loop of the flexible substrate.

6. The electrical connector as recited in claim 5 wherein the flexible substrate comprises an inner surface disposed inside the closed loop and an outer surface disposed opposite the inner surface.

7. The electrical connector as recited in claim 6 further comprising a ground plane disposed on the inner surface.

8. The electrical connector as recited in claim 5 wherein the guide member further comprises a pair of actuation portions extending beyond the closed loop.

9. The electrical connector as recited in claim 5 wherein the guide member further comprises positioning means being engageable with the flexible substrate.

10. The electrical connector as recited in claim 9 wherein the positioning means comprises a notch which receives an edge of the flexible substrate.

11. A card connector assembly comprising:

a card connector for receiving a card device;

a receptacle connector disposed at an angle to said card connector, and a flexible circuit substrate having a signal circuit on one major surface and a grounding plane on the other major surface, said flexible substrate being soldered to said card connector at a rear side thereof and adapted to be removably received into said receptacle connector;

where said flexible circuit substrate is bent at the rear side of said card connector such that at least a portion is angled by at least 90 degrees, and extends rearward toward said receptacle connector generally within a height range determined by a height dimension of said card connector, whereby said receptacle connector receives said flexible circuit at a position close to the height dimension center of said card connector.

12. A card connector assembly of claim 11, wherein said card connector includes a plurality of post terminals projected rearward to be soldered to said flexible circuit substrate.

13. A card connector assembly of claim 11, wherein said receptacle connector includes a metallic guide member for assuring electrical interconnection between said receptacle connector and said flexible circuit substrate.

* * * * *